United States Patent [19]

McQueen

[11] Patent Number: 4,630,543

[45] Date of Patent: Dec. 23, 1986

[54] BOGIE FOR CABLE-DRAWN VEHICLE

[75] Inventor: Norman McQueen, Parker, Colo.

[73] Assignee: Otis Elevator Company, Farmington, Conn.

[21] Appl. No.: 562,137

[22] Filed: Dec. 16, 1983

[51] Int. Cl.[4] ..... B61C 11/02

[52] U.S. Cl. ..... 104/173.1; 104/119; 104/189; 104/198; 104/23.2

[58] Field of Search ..... 104/173 R, 182, 186, 104/189, 197–199, 202, 242, 245, 23 FS, 247, 89, 91, 93, 119, 120; 105/148, 150, 151, 144, 145

[56] References Cited

U.S. PATENT DOCUMENTS

| | | | |
|---|---|---|---|
| 336,245 | 2/1886 | Leavitt | 104/199 |
| 482,279 | 9/1892 | Smith | 104/199 |
| 3,675,583 | 7/1972 | Sobry et al. | 104/247 X |
| 4,089,272 | 5/1978 | Schmitz | 104/247 |
| 4,092,929 | 6/1978 | Laurent | 104/199 X |
| 4,213,396 | 7/1980 | Mehren et al. | 104/247 X |

FOREIGN PATENT DOCUMENTS

| | | | |
|---|---|---|---|
| 63055 | 4/1891 | Fed. Rep. of Germany | 104/199 |
| 2807984 | 2/1978 | Fed. Rep. of Germany | 104/119 |

*Primary Examiner*—David A. Scherbel
*Assistant Examiner*—Glenn B. Foster
*Attorney, Agent, or Firm*—Gerald E. Linden

[57] ABSTRACT

Motion is imparted to a car (12) by a cable (10) that runs along the length of a guideway (14) in sheaves (22). To accommodate directional changes in the guideway (14), the sheaves (22) are oriented in a range of configurations, including orientations (22C, 22D) above the cable (10). A guiderail (30) is located high on a side of the guideway (14) and imparts guidance to the car (12) via a rail follower (38) on the car. A cable clamp (54) attaches the car (12) to the cable (10) and displaces the cable (10) a large amount from the sheaves (22) to avoid impingement of the clamp (54) and sheaves (22). The cable clamp (54) is disposed so as to occupy the area defined by the rail follower (38). Cable supports (56,56), disposed forward and rearward of the cable clamp (54) displace the cable (10) by a small amount from the sheaves (22) and replace the cable (10) onto the sheaves (22). The cable supports (56,56) are disposed so as to occupy the area defined by the cable as displaced (55) by the cable clamp (54).

2 Claims, 3 Drawing Figures

BOGIE FOR CABLE-DRAWN VEHICLE

Cross-reference is made to copending, commonly-owned U.S. Pat. No. 4,550,663 (DeViaris, 1985) entitled TRANSPORTATION SYSTEM HAVING A CABLE DRAWN VEHICLE.

TECHNICAL FIELD

This invention relates to cable-drawn vehicles for traveling in a guideway and, more particularly, to a bogie for attaching the vehicle to the cable and for interacting with a guiderail in the guideway.

BACKGROUND ART

One type of transportation system is a generally horizontal transportation system in which passengers are moved in a vehicle or cab in a guideway. A closed loop of cable or rope runs along one side of the guideway, and it has two opposite moving lengths, one that is attached to the vehicle to drive the vehicle back and forth along the length of the guideway. The cable is driven bidirectionally by an electric motor at one end of the guideway, and is controlled by supervisory equipment to control the stopping, starting, acceleration and speed of the car. The cable rides on sheaves that are located along the side of the guideway. An arm that extends from the vehicle connects to the cable which drives the vehicle. The guideway determines the general direction of the vehicle, and the cable provides the driving force for moving it in the guideway, but directional control is provided to the vehicle by a guiderail that extends along the length of the guideway in conjunction with a rail follower on the vehicle. The arm and the rail follower comprise a "bogie."

In straight sections of the guideway the sheaves that support both lengths of the cable are primarily vertical to support the weight of the cable. But, in curved sections of the guideway, where the vehicle turns left or right, the particular sheave that supports that length of cable that drives the vehicle is oriented slightly horizontal to accommodate the combined horizontal and vertical loads created in turns.

DISCLOSURE OF INVENTION

Therefore, it is an object of this invention to provide a bogie for a cable-drawn vehicle that occupies a minimum amount of space, or cross-sectional area in the guideway, and that performs its functions as well as, if not better than, the apparatus of the prior art, for instance, by providing improved roll stability and by allowing for dips, as when the guideway passes through a valley.

According to the invention, a transportation system comprises a car that is driven longitudinally in a guideway by an attached motor-driven cable. The cable is disposed along a side of the guideway and a plurality of sheaves are also disposed along the side of the guideway at selected locations for supporting the cable. When the guideway changes directions, the orientation of the sheaves changes. When the guideway dips, as in passing through a valley, the sheaves are disposed above the cable. A guiderail is mounted along a wall of the guideway, rather than on the base thereof. A rail follower on the car cooperates with the guiderail to provide lateral guidance and roll stability to the car. A cable clamp connects the car to the cable and displaces the cable a large amount from the sheaves. Two cable supports are disposed, one fore and one aft of the cable clamp, to displace the cable by a small amount from the sheaves and to replace the cable onto the sheaves. The cable clamp is disposed so as to be within the cross sectional area of the guideway that is occupied by the rail follower and the supports are disposed so as to substantially occupy the cross sectional area guideway that is defined by the large displacement of the cable as caused by attachment to the cable clamp.

The foregoing and other objects, features, and advantages of the present invention will become more apparent in the light of the following detailed description of an exemplary embodiment thereof.

BEST MODE FOR CARRYING OUT THE INVENTION

Figure 1:
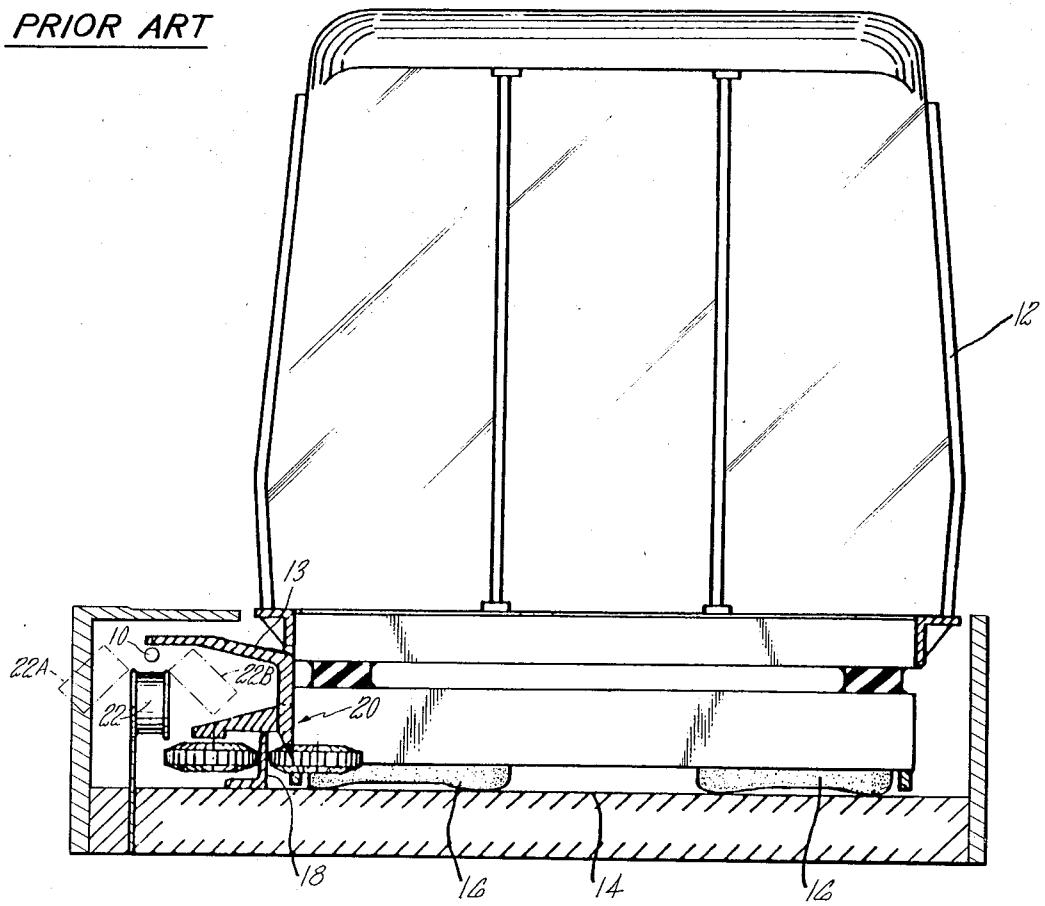
FIG. 1 PRIOR ART
FIG. 1 is a front partial cutaway view of a car, guideway, and other associated elements of the prior art.

In FIG. 1 is shown a transportation system of the prior art wherein a cable 10 imparts motion to a car 12 attached thereto by an arm 13. Since control over the cable motion effects control over the car motion, the use of elevator motors and controls is applicable to such a system. A guideway 14 provides support for the car 12 which is shown suspended on air cushions 16. Thus the car 12 is free to move laterally as well as longitudinally in the guideway 14. As the car 12 moves longitudinally in the guideway 14, lateral guidance for the car 12 is provided by a guiderail 18 which is located at the base of the guideway 14 and a corresponding rail follower assembly 20 on the car 12. The arm 13 and the rail follower 20 together comprise a "bogie".

The cable 10 rides on sheaves 22 which guide and support the cable. The sheaves 22 are positioned at selected locations along the guideway 14 and may be oriented in a number of ways. For instance, the sheave 22 is shown oriented vertically, beneath the cable 10, to provide vertical support to the cable 10. This configuration provides adequate cable support for straight runs, including those wherein the guideway crests a hill. When the guideway 14 curves, the sheaves 22 are oriented to provide both lateral and vertical support to the cable. For instance, if the guideway were curving toward the cable, the sheave would be oriented as shown by the phantom sheave 22A. Similarly, if the guideway were curving away from the cable, the sheave would be oriented as shown by the phantom sheave 22B.

Figure 2:
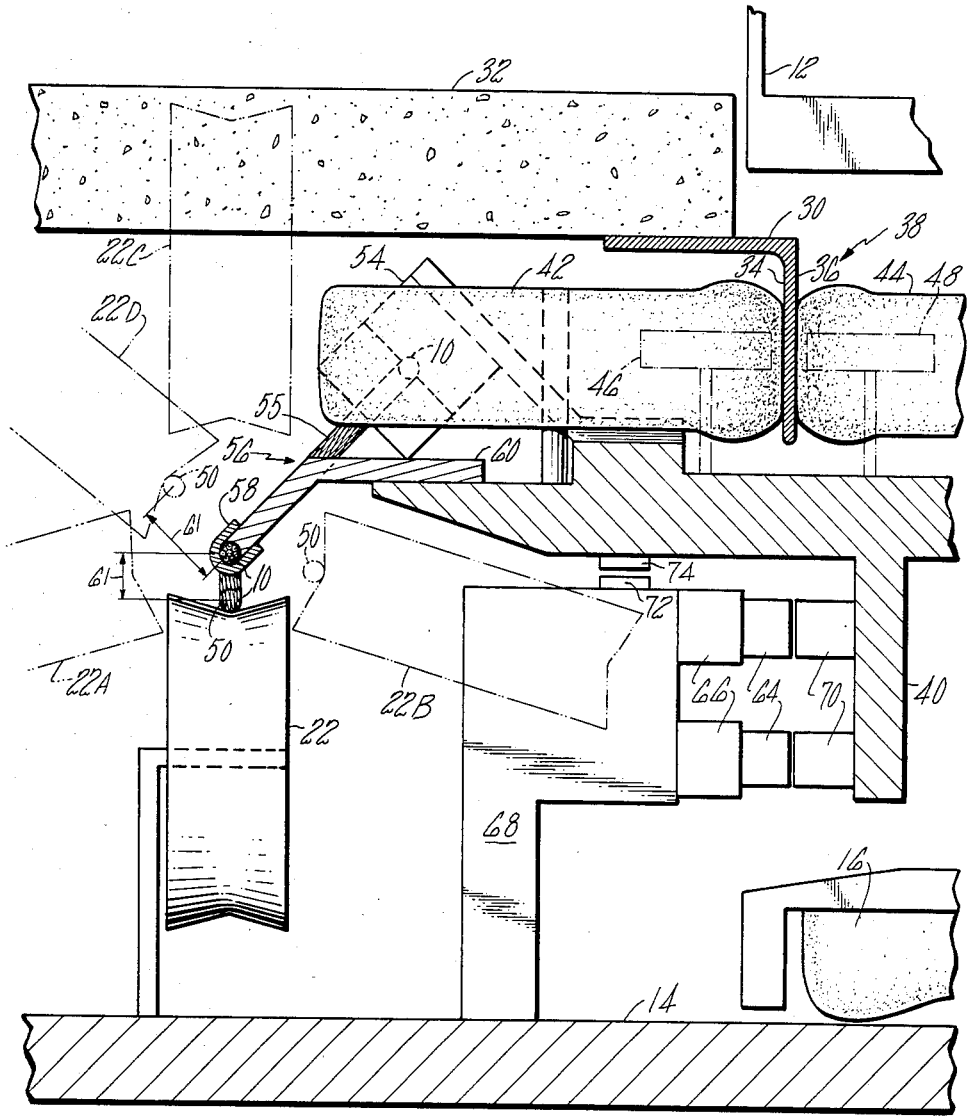
FIG. 2 is a cross-section of the bogie of this invention and associated guideway.

The bogie shown in FIG. 2 is suitable for installation on a car, such as is shown in FIG. 1, provided that certain changes in the guideway configuration are made. More particularly, a guiderail 30 is not disposed on the base of the guideway 14, but rather is attached "upside down" to a wall (not illustrated) or beneath a landing 32 in the guideway. The guiderail 30 is disposed longitudinally in the guideway 14 and has a face 34 that is oriented towards the cable 10 and a face 36 that is oriented away from the cable 10. Both faces 34,36 are perpendicular to the base of the guideway 14 and the guiderail has a thickness associated with the distance between the two faces 34,36.

A rail follower assembly 38 is mounted to a frame 40 which is attached to or part of the frame of the car 12. A wheel (tire) 42 and a wheel (tire) 44 are journaled to the frame 40, and the clearance between the tires, in other words, between their peripheries, corresponds to the thickness of the guiderail so that the tires 42,44 snugly cooperate with the guiderail 30 to provide lateral guidance for the car 12, which is suspended in the guideway 14 by the air-cushion assembly 16. The tires 42,44 have an O.D. on the order of fifteen inches. Each tire defines and occupies a portion of the cross-sectional area of the guideway 14. The cross-sectional areas of the guideway 14 that are occupied by the various elements described herein are significant in the context of packaging a bogie to occupy the least amount of space, which translates into guideway width and height savings, without sacrificing performance.

In the event of a single or multiple tire failure lateral guidance for the car 12 would be impaired. Therefore, a backup guidance system is provided that comprises two safety rollers 46,48 (shown in phantom), each of which is journaled to the frame 40. The roller 46 is disposed within the cross-sectional area defined by the tire 42, and the roller 48 is disposed within the cross-sectional area defined by the tire 44. The clearance between the periphery of the rollers 46,48 is greater than the thickness of the guiderail 30, but not much greater, so that the rollers will provide lateral guidance to the car 12 in the event of a failure of the primary guidance system (i.e., the tires). The lateral play inherent in the backup guidance system must be taken into account in the design of the guideway to allow for worst-case clearance between the car 12 and any obstructions in the guideway 14, and it is preferable that the play not be sufficient to allow the cable to jump off of the sheaves.

One of the major consumers of cross-sectional area in the guideway 14 is the sheaves 22, one of which is shown in solid lines. The cable 10 rides on the sheaves 22, or pulleys, which provide support for the cable and also establish a cable path 50 in the guideway. Since the cable 10 is a closed loop, there is also a return cable path (not shown), inclusion of which in the drawing would only obfuscate the teachings herein. In the general case, the guideway follows a straight and level course. Therefore, the sheaves are disposed as shown by the solid-lined sheave 22. However, other cases are possible. For instance, the guideway may veer toward the cable. In that case, the sheave must be oriented so as to provide lateral, as well as vertical support for the cable, and is thus shown as the phantom sheave 22A. In another case, the guideway veers away from the cable and the sheave must be oriented as shown by the phantom sheave 22B. The guideway may also crest a hill, in which case the sheave would be oriented in its normal position (22). In another case the guideway dips, and it is necessary to provide downward vertical support on the cable, and the sheave must be oriented vertically above the cable 10, as shown by the phantom sheave 22C. Furthermore, the guideway may simultaneously be cresting a hill and turning, in which case the sheave would be in a configuration as shown by the phantom sheaves 22A,22B or in any of the configurations included therebetween (not shown). However, when the guideway dips, it is permissible only that it be turning towards the cable, which would require a sheave 22D. A dipping turn away from the cable would require a sheave to be oriented in the space occupied by the tire 42 and other bogie elements as discussed hereinafter. This design limitation must be accounted for in the planning and layout of a guideway. Therefore, there exists a range of permissible sheave configurations between the sheave 22B and clockwise (as shown) through to the sheave 22C which define a cross-sectional area of the guideway which, since the sheaves are fixed to the guideway 14, is not available to be occupied by any of the apparatus associated with the moving car 12.

A cable clamp 54 attaches the cable 10 to the car 12. The cable clamp must be large, on the order of three to four inches in each dimension, to accommodate the driving force imparted by the cable 10 to the car 12. Since the cable clamp 54 is large, the cable 10 must be displaced from the cable path 50, in other words, from its normal position in the sheaves 22 to be clamped by the cable clamp 54. Otherwise, the clamp 54 would impinge on the sheave 22, 22A, 22B, 22C or 22D. Stated succinctly, the cross-sectional area occupied by the clamp 54 cannot coincide with the cross-sectional area occupied by the range of sheave configurations.

Figure 3:
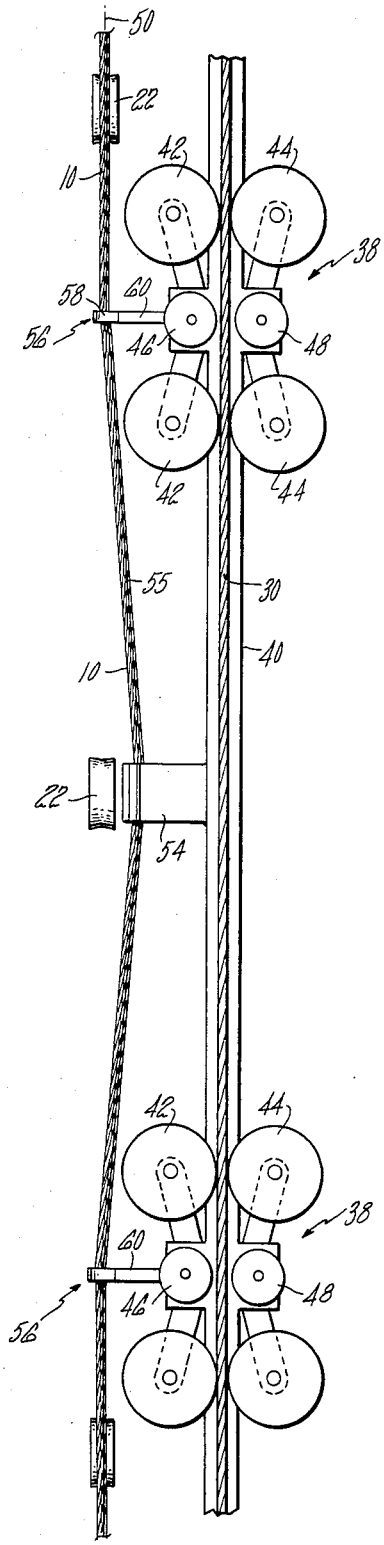
FIG. 3 is a partial top view of the bogie of this invention.

The top view of FIG. 3 provides another perspective of this situation. Therein it may be seen that the cable clamp 54 displaces the cable 10 from the cable path 50 and, in fact, lifts the cable 10 entirely off of the nearby sheave 22. This displacement defines an offset cable path 55, the cross-sectional area of which, in relation to the guideway 14, is best seen in FIG. 2. But, continuing with the discussion of FIG. 3, it is easily seen that the large displacement involved in attaching the cable 10 to the car would quickly derail the cable 10 from the sheaves 22 without additional measures. Therefore, cable supports 56,56 are provided both foreward and rearward of the cable clamp 54 to pick up the cable from a sheave and replace the cable back onto a sheave as the car moves past the sheaves in the guideway. Since a cable support 56 carries no load other than any tension induced by the displacement of the cable 10, a cable support 56 may simply be a thin strap 58 at the end of an arm 60. As a matter of fact, the tension of the displaced cable will tend to hold the cable in the arm 60 and the strap 58 is provided merely to retain the cable 10 in the arm 60 in the event that there is a loss of tension in the cable 10. Therefore, the cable support 56 is small and displaces the cable 10 only a small amount from the cable path 50. Whereas the cable supports 56 are shown disposed in close proximity to the rail followers 38,38, this is simply a matter of manufacturing convenience, and the cable supports 56 may be located anywhere along the frame 40 so long as their foreward and rearward relationship to the cable clamp 54 is maintained.

More significant aspects of the cable supports are described with reference to FIG. 2. The ultimate location of the cable-engaging end of the arm 60 determines the small displacement 61 of the cable 10 from its path 50. Since the strap 58 and the arm 60 are small, the displacement 61 can be correspondingly small, and varies slightly from sheave configuration to sheave configuration. Again, nonimpingement of the cable support 56 with the sheaves is essential. Therefore, the cross-sectional area occupied by the cable support 56 cannot be coincident with the cross-sectional area defined by the range of sheave configurations. This is most conveniently achieved by taking advantage of the fact that the offset cable path 55 defines and occupies a portion of the cross-sectional area of the guideway, and disposing the arm 60, or at least a significant portion thereof, within the cross-sectional area defined by the offset cable path 55. A portion of the arm 60 could also be disposed within the cross sectional area defined by the tire 42.

Since guideway space, i.e., cross-sectional area, is at a premium, it is important to package the various elements of the bogie in as small a space as possible. Therefore, the cable clamp 54 is located so that it occupies substantially the same cross-sectional area that is already occupied by the tire 42 on the cable side of the rail.

Another key feature of this invention is the high location of the guiderail 30 and the rail follower assembly 38 which provides additional roll stability for the car. The location of major guideway space-consuming elements within coincidental cross-sectional areas of the guideway, and providing for a maximum range of sheave configurations is also achieved by this invention.

It is necessary in the case of blowers for the hover pad 16 and in any case for car lighting and other electrical functions within the car 12 to provide power to the car 12. Therefore, a set of power rails 64 are mounted via standoff insulators 66 to a bracket 68 that is mounted to the guideway 14. Power collectors 70 are provided on the car 10 and may be mounted as shown to the frame 40 and in proximity to the rail follower assembly 30 in order to receive power from the power rails 64. Communication may also occur over the power rails 64 in a manner known to the art. Other functions, such as position sensing, may be provided by a module 72 attached to the bracket 68 and a module 74 attached to the frame 40, which modules 72,74 are positioned to cooperate with each other.

The foregoing description of this invention is intended to enable those skilled in the art to practice the invention. Various other embodiments and modifications as are suited to the particular use contemplated will become apparent upon examination and practice of the invention.

What is claimed is:

1. A transportation system comprising:

a guideway having a flat smooth base, a guideway-side, and a longitudinal length, wherein a cross-sectional area of the guideway is defined by a plane normal to the longitudinal length of the guideway;

a vehicle supported by hoverpads above the base of the guideway;

a motor-driven cable disposed in the guideway for imparting motion to the vehicle;

sheaves, disposed at selected locations and orientations in the guideway, for providing both lateral and vertical support to the cable;

two spaced-apart cable support arms, each connected at one end to the vehicle and at the other end to the cable, for displacing the cable from the sheaves and replacing the cable onto the sheaves as the vehicle moves in the guideway;

a cable clamp, disposed on the vehicle between the two cable supports, for attaching the vehicle in driving relationship to the cable;

a vertically-oriented guiderail, disposed along the length of the guideway and having a guideway-side face and an opposite face, for providing guidance to the vehicle as the vehicle moves in the guideway;

a rail follower, disposed on the vehicle, including two horizontally-oriented, horizontally spaced-apart wheels, one wheel disposed on each face of the guiderail, characterized in that:

a first portion of the cross-sectional area of the guideway is defined by the displacement of the cable by the cable support arms and the cable clamp;

the cable support arms are disposed substantially within the first portion of the cross-sectional of the guideway;

a second portion of the cross-sectional area of the guideway is defined by the wheel disposed on the guideway-side face of the guiderail;

the cable clamp is disposed within the second portion of the cross-sectional area of the guideway.

2. A transportation system according to claim 1 wherein the guiderail is disposed at an elevation in the guideway that is substantially coincident with the top of the guidewayside.

* * * * *